United States Patent [19]

Snel et al.

[11] Patent Number: 4,780,702

[45] Date of Patent: Oct. 25, 1988

[54] CHIP RESISTOR AND METHOD FOR THE MANUFACTURE THEREOF

[75] Inventors: Jan Snel; Gerardus Janssen; Ludovicus Vugts; Cornelis W. Berghout, all of Eindhoven, Netherlands; Francis A. C. Gys, Brussels, Belgium

[73] Assignee: U.S. Philips Corporation, New York, N.Y.

[21] Appl. No.: 830,611

[22] Filed: Mar. 21, 1986

[30] Foreign Application Priority Data

Feb. 15, 1985 [NL] Netherlands ..... 8500433

[51] Int. Cl.[4] ..... H01C 1/012

[52] U.S. Cl. ..... 338/308; 338/314

[58] Field of Search ..... 338/307–314; 252/518–521; 427/101–103

[56] References Cited

U.S. PATENT DOCUMENTS 2,935,717 5/1960 Solow ..... 338/332 X

*Primary Examiner*—C. L. Albritton

*Attorney, Agent, or Firm*—Norman N. Spain

[57] ABSTRACT

A chip resistor having a value ranging from 10 Ohm to 100 kOhm and having a low temperature coefficient a low noise level and a high stability. The resistor is manufactured by means of the thin-fil technique. For this purpose, an NiCrAl-resistance layer is applied to one side of a flat ceramic support, and contact strips of Ni or an Ni-alloy, possibly preceded by an intermediate layer, are provided at two ends of the said support. An insulating lacquer layer is then applied to the resistance layer and partly overlaps the contact strips. The solderable supply strips are provided on the exposed metal portions.

4 Claims, 2 Drawing Sheets

CHIP RESISTOR AND METHOD FOR THE MANUFACTURE THEREOF

BACKGROUND OF THE INVENTION

The invention relates to a chip resistor and to a method for the manufacture thereof.

In order to obtain chip resistors having a small tolerance and a low temperature coefficient of resistance in the entire range from 10 Ohm to 100 kOhm, the resistance layers of such resistors can best be produced by means of the thin film technique. This technique utilizes vacuum deposition or sputtering.

British Patent Specification GB-PS No. 991,649 discloses such a resistor which comprises a support to which at least one resistance layer is applied and which resistor comprises at least two flat solderable metal currentsupply strips, each strip consisting of at least two metal layers each, at least the bottom layer of which is vapour deposited.

However, the known structure has so far proved inadequate to produce a resistance layer for a chip resistor having a low temperature coefficient of resistance in the entire range from 10 Ohm to 100 kOhm. The stability of the resistors also leaves a lot to be desired. Undoubtedly the material choice is an important factor herein.

BRIEF SUMMARY OF THE INVENTION

It is an object of the invention to provide a chip resistor which has a low temperature coefficient of resistance in the range from 10 Ohm to 100 kOhm and a high stability, which is capable of withstanding life tests and which exhibits a low level of noise.

The chip resistor in accordance with the invention, which comprises a flat ceramic support, a NiCrAl resistance layer present on one face of the support is provided at two opposite ends with contact strips of nickel or a nickel alloy with Ni as main constituent and, possibly, an intermediate layer of aluminum, an aluminum alloy or chromium, an insulating protective layer which extends over the resistance layer and partly overlaps the contact strips, and solderable metal strips which extend along the sides to the bottom of the support and are provided on the exposed portions of the contact strips.

This construction is based on the insight that the actual resistance layer is not in direct contact with the solderable contact strips. The resistance layer is only in metallic contact with the ends of the layers of nickel, a nickel alloy and possible an intermediate layer of Al, an Al-alloy or chromium, which materials do not exhibit, surprisingly, a diffusion in the resistance layer of NiCrAl. In the manufacture of the chip resistor, after application of the Ni-alloy and the projective layer, the resistance layer is not exposed to attack by material of the other process steps.

DETAILED DESCRIPTION OF THE INVENTION

Figure 1:
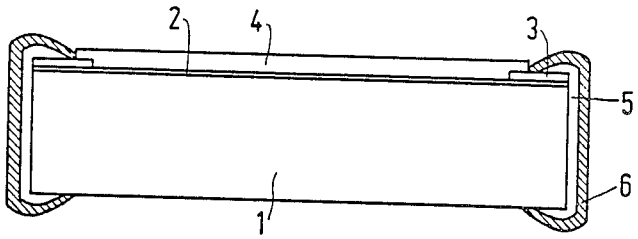
FIG. 1 is a cross-sectional view of a chip resistor in accordance with the invention.

The invention will now be described in greater detail.

The nickel alloy of the contact strips at the two opposite sides of the resistance layer, preferably, comprises a NiV-alloy or a NiCr-alloy containing 7% of V and 10% of Cr, respectively. These alloys are non-magnetic as is desired for magnetron sputtering which is the preferred method of application.

In order to manufacture a chip resistor in accordance with the invention, first a NiCrAl layer is applied to one side of the flat ceramic support, which layer is then coated with a layer of nickel or a nickel alloy with Ni as main constituent, possible preceded by a layer of Al, an Al-alloy or chromium; by means of photo-etching, first the two contact strips and then a pattern in the resistance layer are manufactured, after which an insulating protective lacquer is applied to the resistance layer and partly overlaps the contact strips, next, metal current-supply strips extending along the sides to the bottom of the support are provided on the exposed portions of the contact strips, and finally, a soldering-metal layer is applied to the last-mentioned contact strips.

The resistance layer and the contact strips located at two opposing sides of said resistance layer are preferable applied, as stated above, by means of magnetron sputtering. The metal current-supply strips are first coated with a layer of a metal, preferably nickel, by means of sputtering, preferably magnetron sputtering, after which the said layer is electrically or electrolessly strengthened using nickel. If required, a layer of a lead-tin alloy is superposed by means of electrodeposition.

It is also possible to directly sensitize the metal strips, for example, by means of a solution of stannous chloride and palladium chloride followed by electroless nickel-plating of the said strips.

In the manufacture of the chip resistor, the two opposing contact strips on the resistance layer may well be used to measure the resistance during trimming of the resistance value by means of a laser beam.

In accordance with a further embodiment of the invention, one or more resistors can be integrated according to the new configuration into a hybrid circuit or a resistive network.

In order to explain the invention, the production process used in production of preferred embodiments of the invention will now be described in more detail with reference to the drawings.

By means of magnetron sputtering, a layer of NiCrAl having a thickness of 500 Å and comprising 30.5% by weight of Ni, 57% by weight of Cr and 12.5% by weight of Al, is applied to a substrate of $Al_2O_3$ measuring 96×114 mm; subsequently a 0.5 μm thick layer of NiV comprising 7% by weight of V is applied to the said substrate and finally a coating of a commercially available positive photo resist, for example AZ 1350 J from Shipley, is superposed. For the manufacture of lowohmic resistors, preferably, a double layer is applied which comprises a layer of aluminum, an aluminum alloy or chromium and a layer of NiV, the total thickness of the layers being 1μ. After the substrate has been exposed through a mask and the non-exposed lacquer has been dissolved, the contact strips are formed by etching away the exposed layer of NiV in concentrated HNO3 containing 5% of HCL. This reagent does not attack the NiCrAl-layer. A second similar lithographic operation is carried out, for example, to provide a meander pattern to the NiCrAl so as to obtain a predetermined resistance value. The NiCrAl is etched in an aqueous solution comprising 220 g of cerium ammonium nitrate $Ce(NH_4)_2(NO_3)_6$ and 100 ml of 65% $HNO_3$, per liter.

The NiCrAl-layer is then aged by heating at 300°-350° C. for 3 hours.

By means of a laser beam, the resistors are trimmed to the required value one by one, the resistance value being measured between the contact strips.

Next, a protective layer is applied, for example Probimer 52 marketed by Ciba Geigy or Imagecure marketed by Coates, which layer covers the NiCrAl-coating of each resistor and overlaps the contact strips over approximately 50 μm.

The plates are then scribed between the individual resistors by means of a $CO_2$-laser, i.e. the laser beam burns a series of closely spaced holes in the plates, so that the plates can be parted along these lines to form individual resistors. The plate is first divided into strips by breaking it in the widthwise direction of the resistors; the said strips are then stacked in a jig and provided with side contacts by means of magnetron sputtering, applying first 200 Å of Cr and then approximately 1 μm of NiV.

Subsequently, the strips are parted to form individual chip resistors which are coated in al electroplating drum with in succession 2 μm of Ni and 6 μm of PbSn or Sn.

Such a chip resistor in accordance with the invention, measuring for example $3\times1$, $5\times0{,}63$ $mm^3$ is depicted in FIG. 1 of the accompanying drawing. A substrate (1) carries a NiCrAl-layer (2) contact strips (3), a protective layer (4), side contacts (5) and, finally, a lead-tin layer (6).

With the chip resistors in accordance with the invention, resistors having a very low temperature coefficient after ageing, can be obtained for example, between −10 and $0\times10^{-6}$/° C. at 300 Ohm and $\pm25\times10^{-6}$/° C. at 10 Ohm.

In the case of resistors between 300 Ohm and 100 kOhm, the noise is approximately $1-2\times10^{-2}$ μV/V and for resistors between 300 and 10 Ohm, the noise may increase to approximately $10^{-1}$ μuV/V.

The stability of the resistors is determined by subjecting them to a life test for 1000 hours at 70° C. under a load of ⅛ W.

The maximum tolerance is 0.2% for resistors of 1 kOhm, 0.1% for resistors of 100 kOhm and 0.3% for resistors of 10 Ohm.

Figure 2:
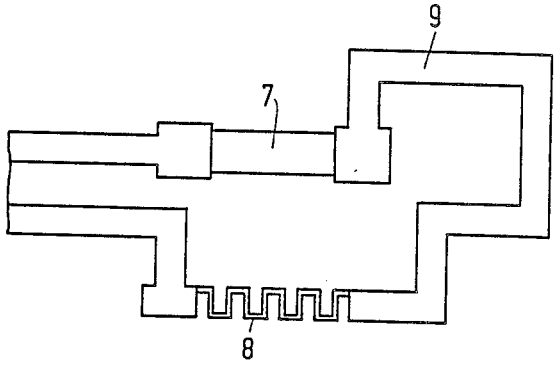
FIG. 2 is a circuit drawing of circuit employing a chip resistor of the invention, FIGS. 3*a*–3*e* inclusive are perspective views of production stages of a circuit of the type shown in FIG. 2

FIG. 2 shows a part of a hybrid circuit in which reference numeral 9 represents printed conductors, 7 a low-ohmic NiCrAl resistor and 8 a high-ohmic resistor. In addition to the resistors already present, still further components (not shown), such as capacitors, potentiometers, transistors and circuit elements on a semiconductor substrate are to be included in this circuit.

Figure 3A:
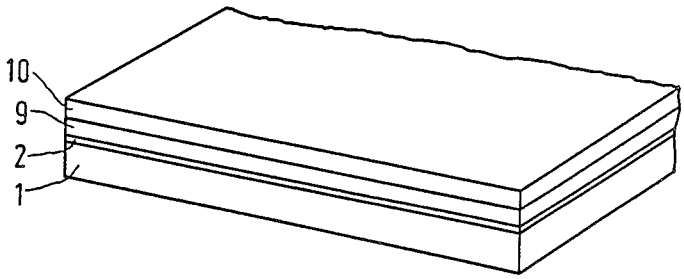

In FIG. 3*a* up to and including 3*e* some of the production stages used in the production of the circuit of FIG. 2 are shown.

Figure 3B:
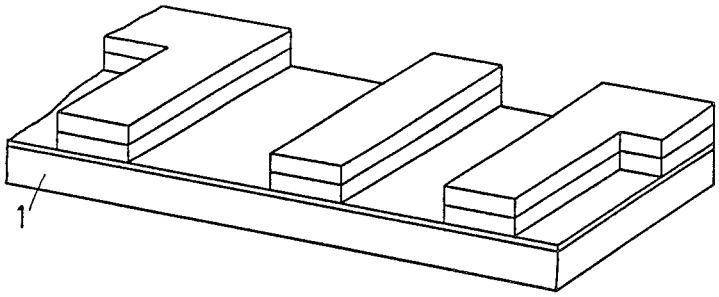
Figure 3C:
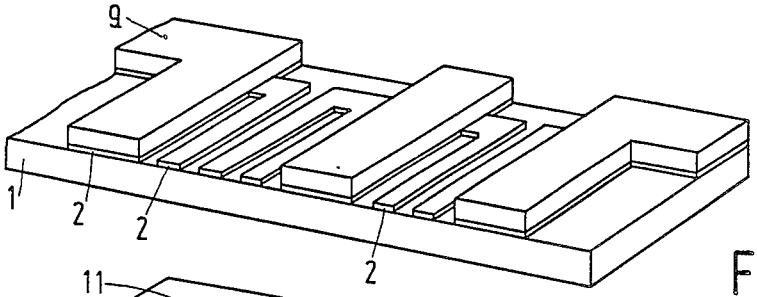
Figure 3D:
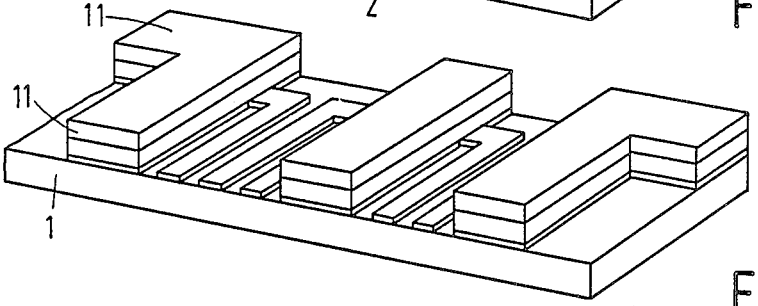
Figure 3E:
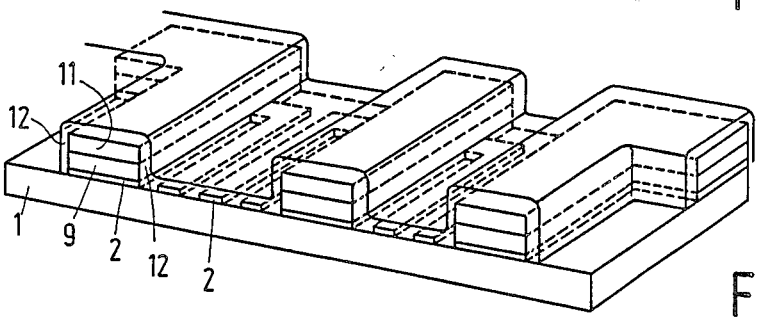

FIG. 3*a* is a cross-sectional view, in which (1) is the substrate, (2) is a uniform NiCrAl layer which is applied by sputtering and (3) is an Ni layer which is applied by electrodeposition, to which layer a layer 4 of a photosensitive lacquer is applied. After exposure and development, the nickel is selectively etched away in accordance with the desired conductor pattern, such that the pattern as shown in FIG. 3*b* is obtained. Another photoresist layer is applied and the desired resistors are selectively removed from layer 2 using an etching agent. After removal of the remaining photo resist the pattern in accordance with FIG. 3*c* is obtained. The printed conductors are provided with a gold layer 11 (FIG. 3*d*) and finally the assembly is provided with a protective lacquer layer 12, leaving the ends of the printed conductors at the edge of the circuit fee.

Figure 4:
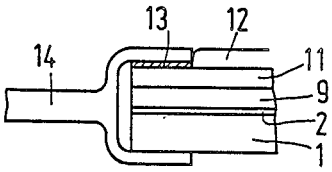
FIG. 4 is a cross-sectional view of a through-connection at one end of a conductor at the edge of the circuit much by the production stages shown in FIGS. 3*a*–3*e*.

FIG. 4 shows how a clamp connection 14 is secured to the end of the conductor by means of a layer of solder 13.

What is claimed is:

1. A chip resistor comprising a flat ceramic-support, said support having two major surfaces and two sides extending between said major surfaces, a NiCrAl resistance layer present on a first major surface of said support, contact strips of nickel or of a nickel alloy with nickel as the main constituent situated on end sections of the surface of said NiCrAl resistance layer, an insulating protective layer extending over said resistance layer and partially extending over said contact strips and solderable metal strips contacting exposed portions of said contact strips, extending along the sides of said support and contacting the other major surface of said support.

2. A chip resistor of claim 1 wherein the contact strips are strips of a nickel vanadium alloy containing approximately 7% of V.

3. A chip resistor of claim 1 wherein the contact strips are strips of nickel chromium alloy containing approximately 10% by weight of Cr.

4. The chip resistor of claim 1 wherein a layer of Al, an Al alloy or Cr is provided between said NiCrAl resistance layer and said contact strips.

* * * * *